US006213020B1

(12) United States Patent
Kawada et al.

(10) Patent No.: US 6,213,020 B1
(45) Date of Patent: Apr. 10, 2001

(54) DRAWING APPARATUS AND DRAWING METHOD

(75) Inventors: Toru Kawada; Shiro Kitawaki, both of Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 0 days.

(21) Appl. No.: 09/366,459

(22) Filed: Aug. 3, 1999

(30) Foreign Application Priority Data

Aug. 4, 1998 (JP) ..... 10-220908

(51) Int. Cl.[7] ..... B41L 3/02
(52) U.S. Cl. ..... 101/486; 101/401.1
(58) Field of Search ..... 101/401.1, 415.1, 101/477, 485, 486, 463.1, 467, DIG. 36

(56) References Cited

U.S. PATENT DOCUMENTS 4,833,985 * 5/1989 Kojima et al. ..... 101/401.1
5,842,397 * 12/1998 Shimizu et al. ..... 83/54
5,865,118 * 2/1999 Fromson et al. ..... 101/463.1
5,896,815 * 4/1999 Sickert ..... 101/401.1
6,016,752 * 1/2000 Harari ..... 101/486
6,076,464 * 6/2000 Okamura ..... 101/401.1

* cited by examiner

*Primary Examiner*—Ren Yan
(74) *Attorney, Agent, or Firm*—Ostrolenk, Faber, Gerb, & Soffen, LLP

(57) ABSTRACT

A conveying unit is disposed so as to be swingable above a recording drum. The conveying unit has a first plate carry-in conveying path and a second plate carry-out conveying path. A punching device is disposed in the plate on the side of a front end of the conveying unit. The plate is conveyed to the punching device through the first conveying path in the conveying unit before being conveyed onto the recording drum. Recording drum positioning holes and printing machine positioning holes are formed at a front end of the plate. The recording drum positioning holes of the plate are respectively fitted on positioning pins provided on an outer peripheral surface of the recording drum.

18 Claims, 9 Drawing Sheets

DRAWING APPARATUS AND DRAWING METHOD

BACKGROUND OF THE INVENTION

1. Field of the Invention

The present invention relates generally to a drawing apparatus and a drawing method of drawing an image on a plate mounted on an outer peripheral surface of a drum.

2. Description of the Background Art

Drawing apparatuses for drawing an image upon irradiation of a plate used for printing with light have been used. In a drum-type drawing apparatus, a plate is mounted on a recording drum which is rotatable in a primary scanning direction, and a recording head comprising a laser diode and the like is moved in a secondary scanning direction parallel to a rotary shaft of the recording drum, to draw an image on the plate.

FIG. 9 is a schematic perspective view of a recording drum in a conventional drawing apparatus. A plate 160 made of aluminum serving as a recording material is mounted on a recording drum 150 shown in FIG. 9. A front end clamp 170 for fixing one end of the plate 160 and a rear end clamp 180 for fixing the other end of the plate 160 are mounted on an outer peripheral surface of the recording drum 150. The rear end clamp 180 contains a magnet, and is fixed by a magnetic force to a position, on the outer peripheral surface of the recording drum 150, corresponding to the size of the plate 160.

The recording drum 150 having the plate 160 attached thereto is rotated at relatively low speed around a rotary shaft 190, so that an image is drawn on the surface of the plate 160.

In the conventional drawing apparatus, positioning pins (not shown) for positioning the plate 160 are provided on the outer peripheral surface of the recording drum 150. Positioning holes for a recording drum (hereinafter referred to as recording drum positioning holes) to be respectively fitted on the positioning pins are formed at one end of the plate 160. In mounting the plate 160 on the recording drum 150, the recording drum positioning holes of the plate 160 are respectively fitted on the positioning pins of the recording drum 150. Accordingly, it is possible to accurately position the plate 160 on the outer peripheral surface of the recording drum 150.

On the other hand, positioning pins for positioning the plate 160 are also provided on the body of a printing machine. The positions of the positioning pins differ depending on the specification of the printing machine. Therefore, in the plate 160, positioning holes for a printing machine (hereinafter referred to as printing machine positioning holes) must be respectively formed in positions corresponding to the specification of the printing machine.

Generally after the image is drawn on the plate 160 by the drawing apparatus, the printing machine positioning holes are respectively formed in predetermined positions of the plate 160 on the basis of an end surface of the plate 160 using a punching machine. The plate 160 can be positioned on the body of the printing machine by respectively fitting the printing machine positioning holes formed in the plate 160 on the positioning pins of the printing machine.

However, the size of the plate 160 varies. When the printing machine positioning holes are formed on the basis of the end surface of the plate 160 after the image is drawn by the drawing apparatus, the relationship between the image formed on the plate 160 and the printing machine positioning holes varies. In this case, the shift in the position for printing must be corrected by shifting the plate 160 mounted on the body of the printing machine while seeing the results of the printing obtained by the printing machine using the plate 160. Therefore, printing work becomes complicated.

SUMMARY OF THE INVENTION

An object of the present invention is to provide a drawing apparatus capable of accurately positioning a plate in a printing machine irrespective of the variation in the size of the plate.

Another object of the present invention is to provide a drawing method in which a plate can be accurately positioned in a printing machine irrespective of the variation in the size of the plate.

A drawing apparatus for drawing an image on a plate used for a printing machine having a positioning portion according to one aspect of the present invention comprises a cylindrical drum having a rotary shaft, an outer peripheral surface on which the plate is mounted and a positioning portion provided on the outer peripheral surface, a driving device for rotating the drum around the rotary shaft, a drawing unit for drawing an image on the plate mounted on the outer peripheral surface of the drum, and a fitting portion forming device for forming in the plate a first fitting portion to be fitted to the positioning portion of the drum and a second fitting portion to be fitted to the positioning portion of the printing machine before the plate is mounted on the drum.

In the drawing apparatus, the positioning portion is provided on the outer peripheral surface of the drum. Before the plate is mounted on the drum, the first fitting portion to be fitted to the positioning portion of the drum and the second fitting portion to be fitted to the positioning portion of the printing machine are simultaneously formed in the plate by the fitting portion forming device.

Thereafter, the plate is mounted on the outer peripheral surface of the drum in a state where the first fitting portion of the plate is fitted to the positioning portion on the outer peripheral surface of the drum. It is possible to draw an image on the plate on the outer peripheral surface of the drum by the drawing unit while rotating the drum having the plate mounted thereon around the rotary shaft by the driving device. At the time of printing, the second fitting portion of the plate is fitted to the positioning portion of the printing machine, so that the printing is done using the plate.

The first fitting portion and the second fitting portion are thus simultaneously formed in the plate. The image is drawn by the drawing unit in a state where the first fitting portion of the plate is fitted to the positioning portion of the drum. Therefore, the relationship between the image formed on the plate and the second fitting portion can be kept constant irrespective of the variation in the size of the plate. Consequently, it is possible to accurately position the plate in the printing machine in doing the printing by the printing machine using the plate, so that the position of printing is not shifted. As a result, no work for correcting the shift in the position of printing is required, thereby improving the efficiency of the printing work.

The positioning portion of the drum may be a positioning pin, the positioning portion of the printing machine may be a positioning pin, the first fitting portion may be a first positioning hole to be fitted on the positioning pin of the drum, and the second fitting portion may be a second positioning hole to be fitted on the positioning pin of the printing machine.

In this case, when the plate is mounted on the drum, the plate can be positioned on the outer peripheral surface of the drum by fitting the first positioning hole of the plate on the positioning pin of the drum. When the printing is done, the plate can be accurately positioned in the printing machine by fitting the second positioning hole of the plate on the positioning pin of the printing machine.

The fitting portion forming device may comprise a plurality of punching units for forming the first and second positioning holes in the plate.

In this case, the first and second positioning holes are simultaneously formed in the plate by the plurality of punting units. Consequently, the relationship between the first positioning hole and the second positioning hole is kept constant, so that the relationship between the image formed on the plate and the second positioning hole is kept constant.

The fitting portion forming device may further comprise a supporting member disposed in a predetermined position, and a mounting member provided in the supporting member so as to be attachable or detachable and having the plurality of punching units carried thereon.

In this case, the mounting member having the plurality of punching units carried thereon is provided so as to be attachable or detachable in the supporting member. By preparing a plurality of mounting members corresponding to a plurality of types of plates and a plurality of types of printing machines and replacing the mounting member in conformity with the size of the plate and the specification of the printing machine, therefore, it is possible to simultaneously form the first and second positioning holes in suitable positions corresponding to the various types of plates and printing machines.

The supporting member may have a reference surface, and mounting member may have one end surface which is abutted against the reference surface of the supporting member.

In this case, the one end surface of the mounting member is abutted against the reference surface of the supporting member, thereby making it possible to accurately and easily position the mounting member on the supporting member.

The fitting portion forming device may further comprise a positioning mechanism for positining the plate in a predetermined position of the supporting member.

In this case, the plate can be put in the predetermined position of the supporting member by the positioning mechanism. Consequently, it is possible to accurately form the first and second positioning holes in predetermined positions of the plate.

The positioning mechanism may comprise a pair of abutting members provided so as to be abuttable against both the side surfaces of the plate upon being moved from on the both sides of the plate toward the center thereof, and an abutting member driving device for moving the pair of abutting members from on the both sides of the plate toward the center thereof.

In this case, the pair of abutting members is abutted against both the side surfaces of the plate upon being moved from on the both sides of the plate toward the center thereof by the abutting member driving device. Accordingly, the plate is put in the predetermined position while being moved in the width direction.

The fitting portion forming device may further comprise adsorbing and holding means for adsorbing and holding the plate on the supporting member.

In this case, the first and second positioning holes are formed in accurate positions of the plate by the plurality of punching units in a state where the plate is adsorbed and held on the supporting member by the adsorbing and holding means.

The drawing apparatus may further comprise selection means for selecting the plurality of punching units.

In this case, it is possible to provide the plurality of punching units corresponding to the plurality of types of plates and the plurality of types of printing machines, and to select the punching units conforming to the size of the plate and the specification of the printing machine by the selection means. Consequently, it is possible to simultaneously form the first and second positioning holes corresponding to the various types of plates and printing machines without replacing the punching units.

The drawing apparatus may further comprise a conveying unit for conveying the plate to the fitting portion forming device, and then conveying the plate to the drum.

In this case, the plate is conveyed to the fitting portion forming device by the conveying unit, and the plate having the first and second fitting portions formed therein is conveyed to the drum by the fitting portion forming device, so that the image is drawn by the drawing unit.

The conveying unit may further comprise a first conveying path for conveying the plate to the fitting portion forming device and the drum, and a swinging mechanism for swinging the first conveying path between the fitting portion forming device and the drum.

In this case, the first conveying path is swung toward the fitting portion forming device by the swinging mechanism, and the plate is conveyed to the fitting portion forming device through the first conveying path. After the first and second fitting portions are formed in the plate by the fitting portion forming device, the plate is then returned to the first conveying path. Thereafter, the first conveying path is swung toward the drum by the swinging mechanism, so that the plate is conveyed to the drum from the first conveying path. The plate is thus smoothly conveyed to the fitting portion forming device and the drum through the first conveying path.

The conveying unit may further comprise a second conveying path for conveying the plate removed from the drum.

In this case, the plate removed from the drum is conveyed through the second conveying path other than that in a case where the plate is conveyed to the fitting portion forming device and the drum.

A method of drawing an image on a plate which is used for a printing machine having a positioning portion and mounted on an outer peripheral surface of a cylindrical drum according to another aspect of the present invention, wherein the drum has a rotary shaft and a positioning portion provided on the outer peripheral surface, comprises the steps of forming in the plate a first fitting portion to be fitted to the positioning portion of the drum and a second fitting portion to be fitted to the positioning portion of the printing machine, mounting the plate having the first fitting portion and the second fitting portion formed therein on the outer peripheral surface of the drum, and drawing an image on the plate on the outer peripheral surface of the drum while rotating the drum around the rotary shaft.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
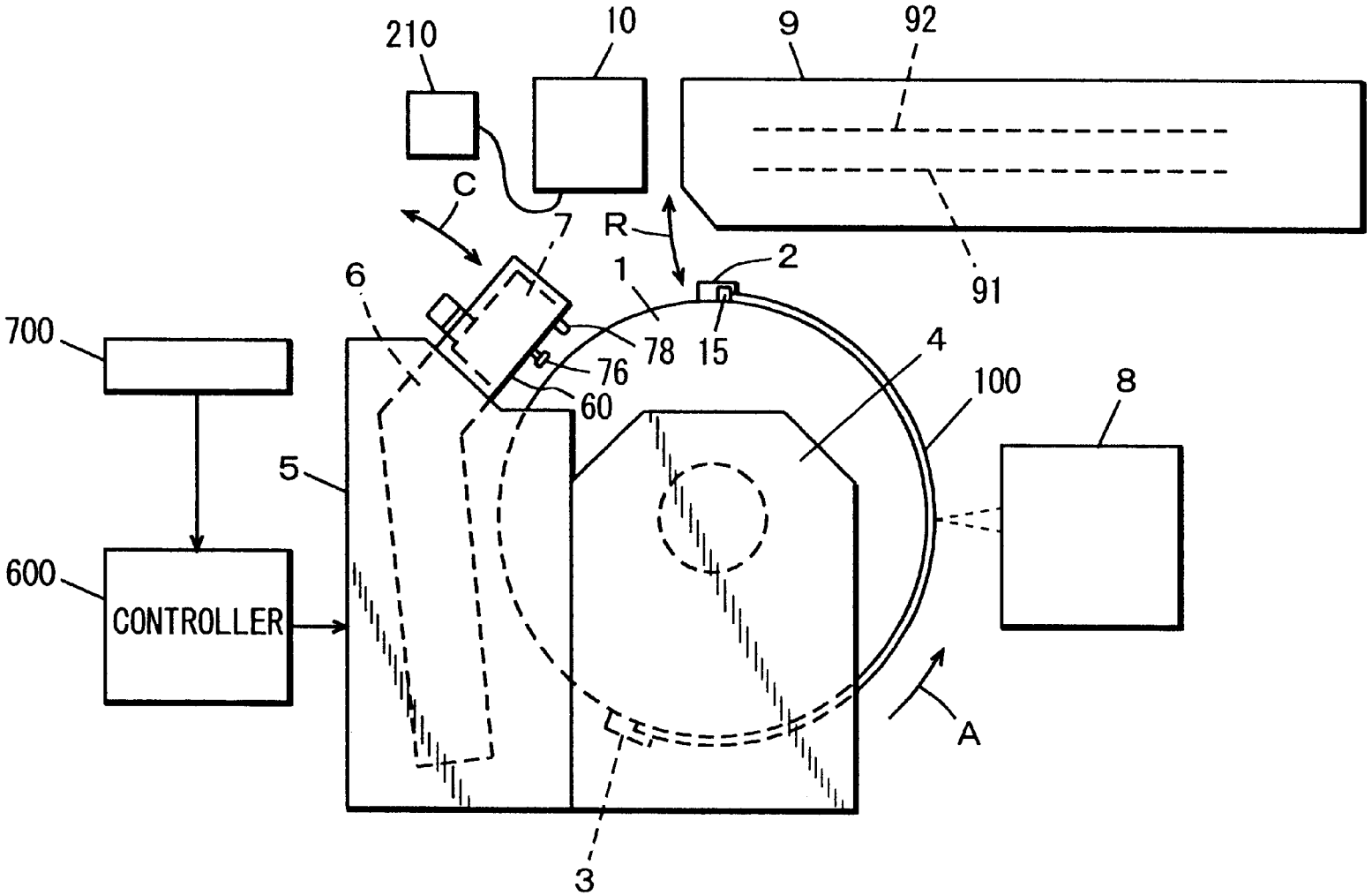
FIG. 1 is a schematic side view of a drawing apparatus in one embodiment of the present invention.
Figure 2:
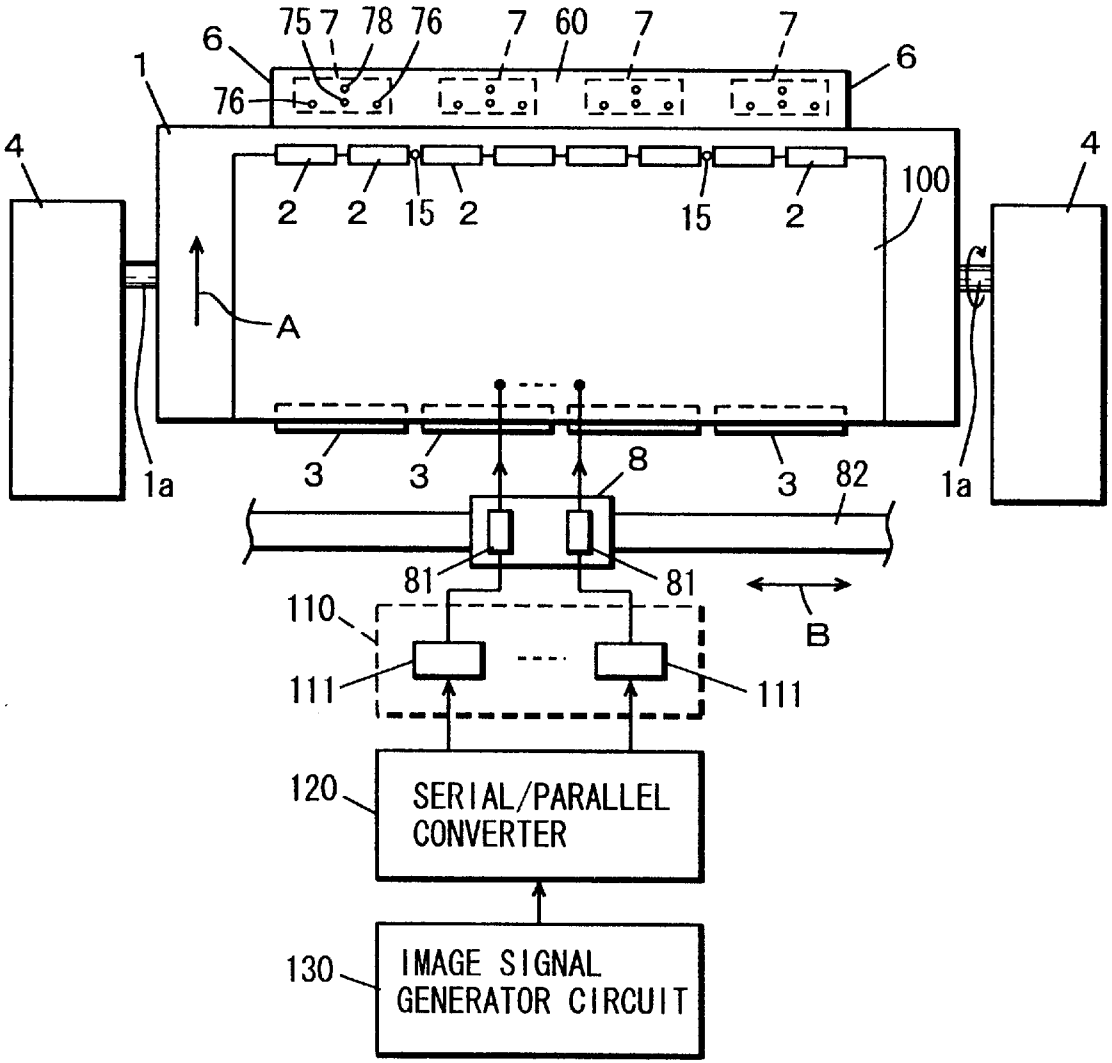
FIG. 2 is a schematic front view of the drawing apparatus shown in FIG. 1.

FIG. 1 is a schematic side view of a drawing apparatus in one embodiment of the present invention, and FIG. 2 is a schematic front view of the drawing apparatus shown in FIG. 1.

In FIGS. 1 and 2, the drawing apparatus comprises a cylindrical recording drum 1. The recording drum 1 is rotated in a direction indicted by an arrow A (a primary scanning direction) around a rotary shaft 1*a* by a rotation driving device 4. A plate 100 made of aluminum is mounted as a recording material on an outer peripheral surface of the recording drum 1. One end of the plate 100 is fixed to the outer peripheral surface of the recording drum 1 by a plurality of front end clamps 2, and the other end of the plate 100 is fixed to the outer peripheral surface of the recording drum 1 by a plurality of rear end clamps 3.

As shown in FIG. 2, a recording head 8 comprising a plurality of laser diodes 81 is disposed ahead of the recording drum 1. The recording head 8 is attached to a guide 82 so as to be movable, and is moved in a direction indicated by an arrow B (a secondary scanning direction) in synchronization with the rotation of the recording drum 1.

The plurality of laser diodes 81 in the recording head 8 are driven by a laser diode driving circuit portion 110. The laser diode driving circuit portion 110 comprises a plurality of laser diode driving circuits 111 corresponding to the plurality of laser diodes 81 in the recording head 8.

An image signal generator circuit 130 generates a serial image signal. A serial/parallel converter 120 converts the serial image signal generated by the image signal generator circuit 130 into parallel image signals, and respectively feeds the parallel image signals to the plurality of laser diode driving circuits 111 in the laser diode driving circuit portion 110. Consequently, each of the laser diodes 81 in the recording head 8 is driven by the corresponding laser diode driving circuit 111, to irradiate the plate 100 with laser light.

As shown in FIG. 1, a clamp driving device 5 is provided behind the recording drum 1. The clamp driving device 5 is used for attaching the rear end clamps 3 to the recording drum 1, detaching the rear end clamps 3 from the recording drum 1, and releasing the front end clamps 2 on the recording drum 1.

The clamp driving device 5 comprises a pair of clamp arms 6 which is swingable in a direction indicated by an arrow C. A driving bar 60 is mounted between the pair of clamp arms 6, and a plurality of first driving devices 7 are attached to the driving bar 60. As shown in FIG. 2, each first driving device 7 is provided with a driving pin 75 for fixing and releasing the rear end clamp 3, two holding pins 76 for holding the rear end clamp 3, and a release pin 78 for releasing the front end clamps 2 at the time of attaching the plate 100. The clamp driving device 5 comprises second driving devices (not shown) for releasing the front end clamps 2 at the time of detaching the plate 100.

As shown in FIG. 1, a conveying unit 9 is disposed so as to be swingable in a direction indicated by an arrow R above the recording drum 1. The conveying unit 9 has a first plate carry-in conveying path 91 and a second plate carry-out conveying path 92. When the plate 100 is carried into the recording drum 1, the plate 100 is supplied onto the recording drum 1 through the first conveying path 91 in the conveying unit 9. When the plate 100 is carried out of the recording drum 1, the plate 100 which has been detached from the recording drum 1 is carried outward through the second conveying path 92 in the conveying unit 9.

A punching device 10 for forming recording drum positioning holes and printing machine positioning holes in the plate 100 is disposed on the side of a front end of the conveying unit 9. The plate 100 is supplied to the punching device 10 through the first conveying path 91 in the conveying unit 9 before being supplied onto the recording drum 1. Accordingly, the recording drum positioning holes and the printing machine positioning holes are formed at a front end of the plate 100. The recording drum positioning holes of the plate 100 are respectively engaged with positioning pins 15 provided on the outer peripheral surface of the recording drum 1.

A controller 600 shown in FIG. 1 comprises a CPU (Central Processing Unit), an input-output interface, and so forth, and controls the respective units of the drawing apparatus. An operation panel 700 for a worker entering various types of information such as the size of the plate 100 and various types of instructions is connected to the controller 600.

Figure 3A:
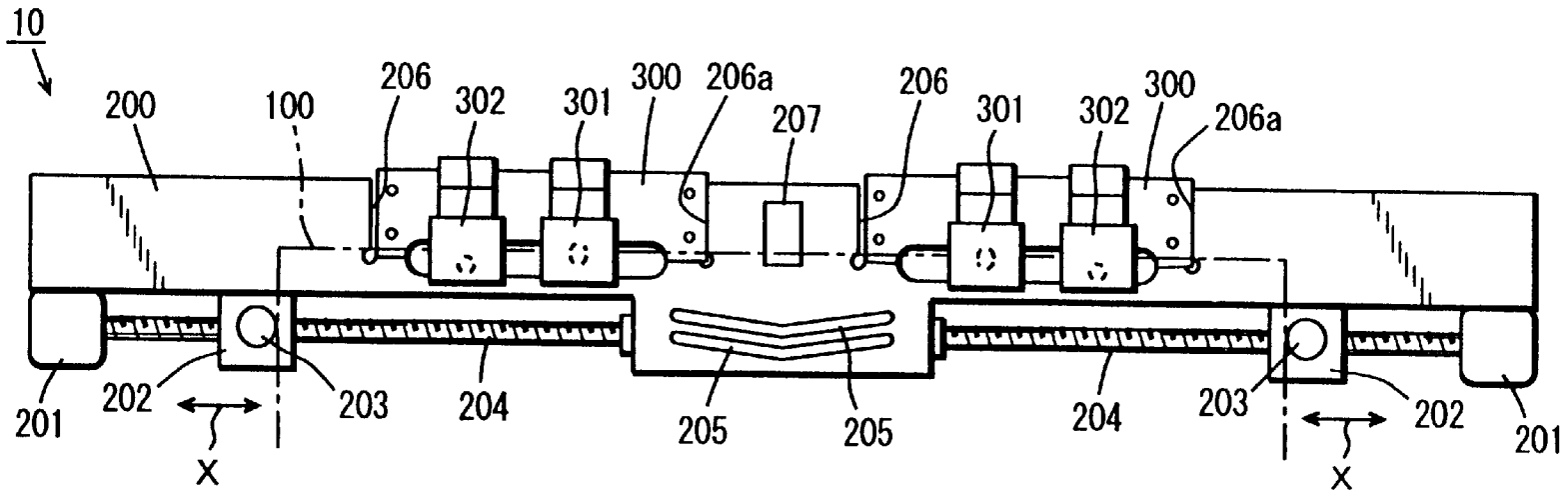
FIG. 3A is a plan view.
Figure 3B:
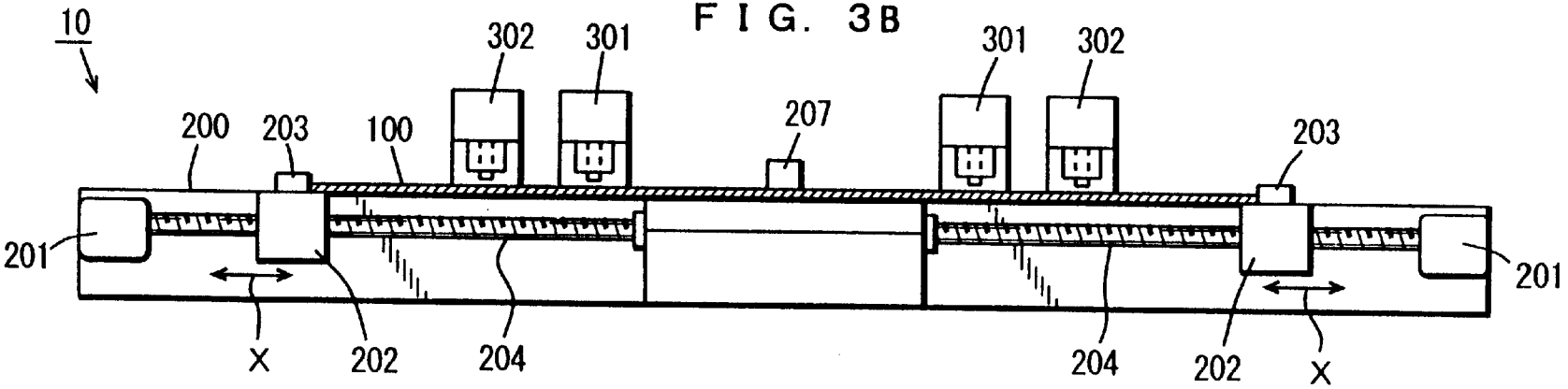
FIG. 3B is a front view of a punching device in the drawing apparatus shown in FIG. 1.
Figure 4:
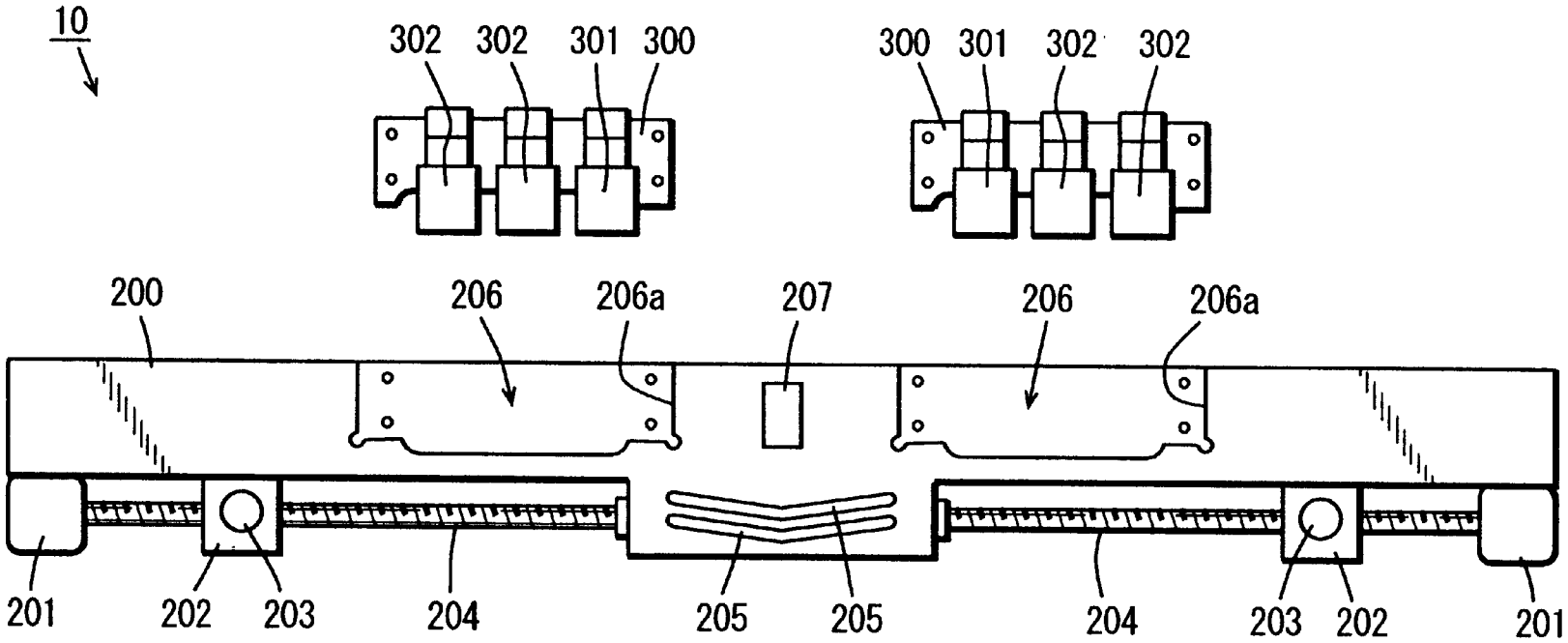
FIG. 4 is a plan view showing replacement of templates in the punching device shown in FIG. 3.

FIG. 3A is a plan view of the punching device 10, and FIG. 3B is a front view of the punching device 10. FIG. 4 is a plan view showing replacement of templates in the punching device 10.

As shown in FIGS. 3A and 3B, the punching device 10 comprises a punching base 200. Motors for moving the plate 100 in the width direction (hereinafter referred to as moving motors) 201 are respectively attached to both ends of a front surface of the punching base 200. A pair of ball threads 204 extending in the horizontal direction along the front surface of the punching base 200 is provided so as to be rotatable. Each of the ball threads 204 is rotated by the moving motor 201.

A bearing for moving the plate 100 in the width direction (hereinafter referred to as a moving bearing) 202 is meshed with each of the ball threads 204. A cylindrical holder 203 is provided so as to be rotatable on the upper surface of each moving bearing 202. The moving bearings 202 are moved in a direction indicated by an arrow X by the rotation of the moving motors 201. The plate 100 is disposed between the pair of moving bearings 202.

Vacuum adsorption grooves 205 are formed on the side of the front surface at the center of the upper surface of the punching base 200. The vacuum adsorption grooves 205 are connected to a suction source 210 shown in FIG. 1 such as a vacuum pump or an aspirator through piping. The reverse surface of the plate 100 on the vacuum adsorption grooves 205 is drawn by operating the suction source 210, so that the plate 100 is adsorbed and held in the upper surface of the punching base 200.

A pair of rectangular recesses 206 is provided on the side of the rear surface on the upper surface of the punching base 200 (see FIG. 4). Templates 300 are respectively mounted on the recesses 206. One or a plurality of punching blocks for a recording drum (hereinafter referred to as recording drum punching blocks) 301 for forming in the plate 100 the recording drum positioning holes to be respectively fitted on the positioning pins 15 of the recording drum 1 are attached to the template 300. Further, one or a plurality of punching blocks for a printing machine (hereinafter referred to as printing machine punching blocks) 302 for forming in the plate 100 the printing machine positioning holes to be respectively fitted on the printing machine positioning pins are attached to the template 300.

One end surface of the template 300 is abutted against one side surface to be a reference surface 206*a* of the recess 206, and the other end surface thereof is urged toward the reference surface 206a by urging means such as a spring, so that the template 300 is positioned in the recess 206.

A plurality of types of templates 300 are prepared in conformity with the size of the plate 100 and the specification of the printing machine. Each template 300 shown in FIG. 3 has one recording drum punching block 301 and one printing machine punching block 302 carried thereon. The templates 300 shown in FIG. 3 can be also detached and replaced with templates 300 shown in FIG. 4. Each template 300 shown in FIG. 4 has one recording drum punching block 301 and two printing machine punching blocks 302 carried thereon.

Each of the templates 300 can be also provided with a plurality of punching blocks 301 corresponding to a plurality of types of plates 100, to select the punching block 301 to be used for forming the recording drum positioning holes by entry from the operation panel 700 shown in FIG. 1 in conformity with the size of the plate 100 to be used. Alternatively, it can be also provided with a plurality of punching blocks 302 corresponding to a plurality of types of printing machines, to select the punching block 302 to be used for forming the printing machine positioning holes by entry from the operation panel 700 shown in FIG. 1 in conformity with the specification of the printing machine to be used for printing.

A plate front end detecting sensor 207 for detecting the front end of the plate 100 is provided at the center of the upper surface of the punching base 200. When the plate 100 is arranged between the moving bearings 202, and the front end of the plate 100 is inserted into the punching blocks 301 and 302 which are attached to the templates 300, the plate front end detecting sensor 207 is turned on.

When the pair of moving bearings 202 is moved toward the center of the punching base 200 by rotating the moving motors 201 from a predetermined position of an origin, outer peripheral surfaces of the holders 203 in the moving bearings 202 are respectively abutted against both the side surfaces of the plate 100. Accordingly, the plate 100 is positioned at the center of the punching base 200. Thereafter, the reverse surface of the plate 100 is drawn through the vacuum adsorption grooves 205 by the suction source 210. Consequently, the plate 100 is fixed to a predetermined position of the punching base 200.

In this state, the recording drum positioning holes are formed at the front end of the plate 100 by the recording drum punching blocks 301 and at the same time, the printing machine positioning holes are respectively formed in predetermined positions of the plate 100 by the printing machine punching blocks 302.

The templates 300 conforming to the size of the plate 100 and the specification of the printing machine may be mounted on the recess 206 of the punching base 200. Alternatively, the templates 300 having the plurality of punching blocks 301 and 302 corresponding to the plurality of types of plates 100 and the plurality of types of printing machines carried thereon may be mounted, to select the punching blocks 301 and 302 to be used on the basis of the information entered from the operation panel 700.

Figure 5A:
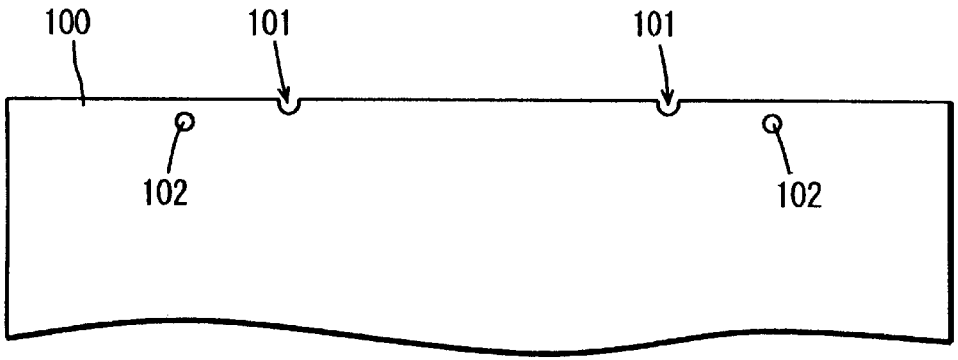
FIG. 5A is a plan view of a plate having recording drum positioning holes and printing machine positioning holes formed therein and FIG. 5B is a plan view showing a state where the plate is positioned on an outer peripheral surface of a recording drum.
Figure 5B:
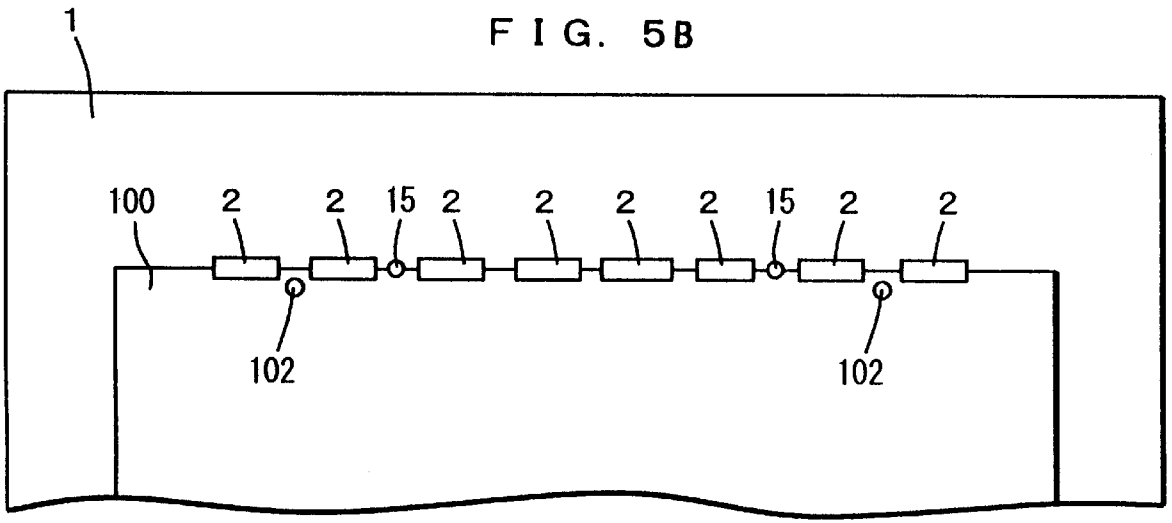

FIG. 5A is a plan view of the plate 100 having recording drum positioning holes and printing machine positioning holes formed therein, and FIG. 5B is a plan view showing a state where the plate 100 is positioned on the outer peripheral surface of the recording drum 1.

In FIG. 5A, two recording drum positioning holes 101 in a U shape are formed at the front end of the plate 100, and two printing machine positioning holes 102 are formed in the vicinity of the front end of the plate 100.

In FIG. 5B, the recording drum positioning holes at the front end of the plate 100 are respectively positioned on the positioning pins 15 on the outer peripheral surface of the recording drum 1, and the front end of the plate 100 is fixed to the outer peripheral surface of the recording drum 1 by the front end clamps 2.

Figure 6:
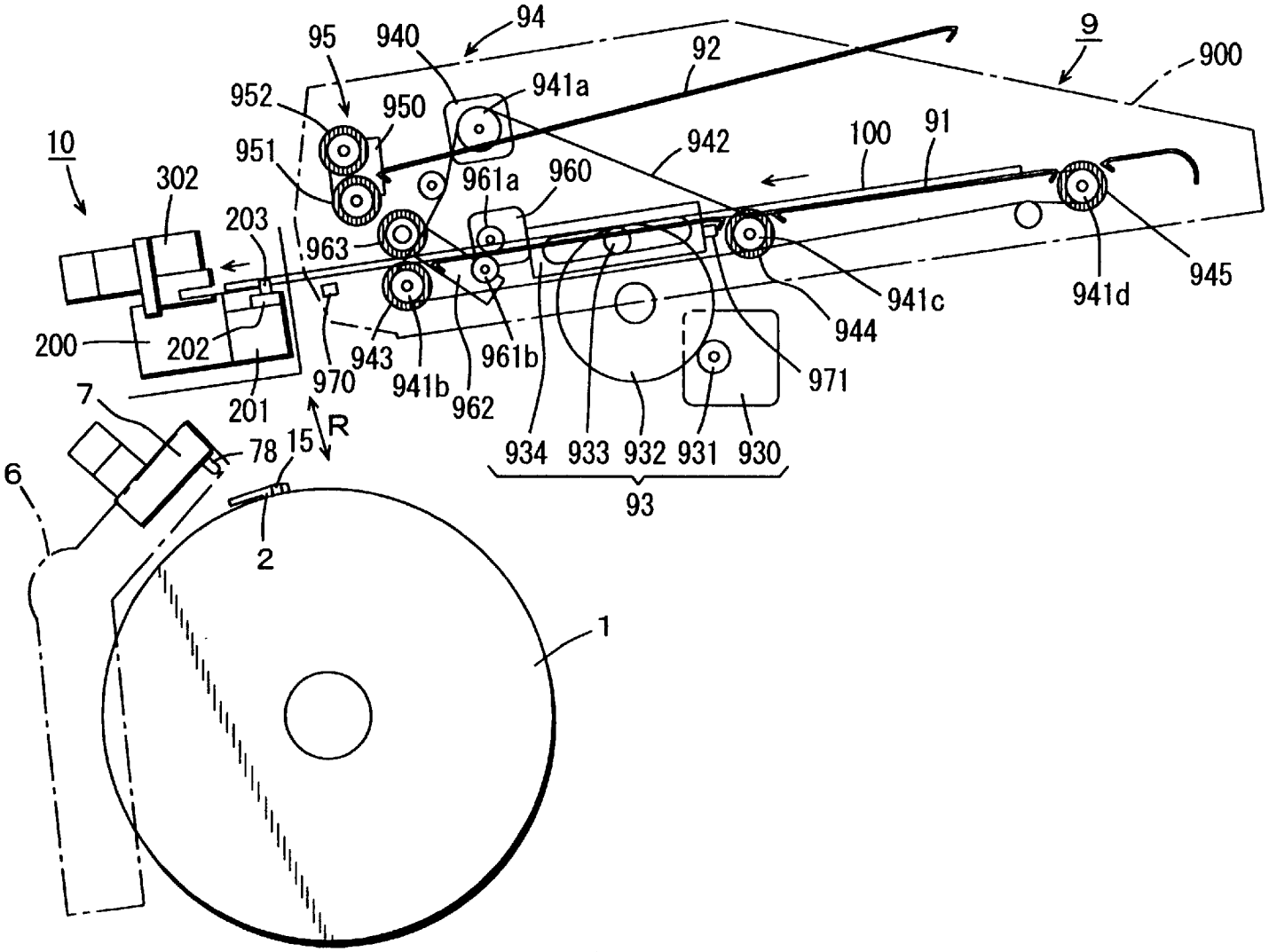
FIG. 6 is a side view showing the construction of a conveying unit in the drawing apparatus shown in FIG. 1.

FIG. 6 is a side view showing the construction of the conveying unit 9.

The conveying unit 9 has the first plate carry-in conveying path 91, the second plate carry-out conveying path 92, a conveying path switching mechanism 93, a first conveying mechanism 94, and a second conveying mechanism 95 provided in a unit main body 900.

The conveying path switching mechanism 93 is constituted by a conveying path switching motor 930, a gear 931, a cam gear 932, a cam follower 933, and a cam follower guide 934. The gear 931 is attached to the conveying path switching motor 930, the cam gear 932 is meshed with the gear 931, and the cam follower 933 is fixed to the cam gear 932. The cam follower 933 is engaged with the cam follower guide 934. The cam follower guide 934 is fixed to the unit main body 900. The unit main body 900 is supported so as to be swingable by a predetermined supporting member (not shown), centered around its rear part.

When the conveying path switching motor 930 is rotated, the cam gear 932 is rotated through the gear 931, and the cam follower guide 934 is moved up and down by the cam follower 933 fixed to the cam gear 932. Consequently, the conveying unit 9 swings in a direction indicated by an arrow R.

The first conveying mechanism 94 is constituted by a conveying roller driving motor 940, pulleys 941*a*, 941*b*, 941*c*, and 941*d*, a belt 942, and three conveying rollers 943, 944, and 945. The pulley 941*a* is attached to the conveying roller driving motor 940, and the pulleys 941*b*, 941*c*, and 941*d* are respectively attached to the conveying rollers 943, 944, and 945. Torque developed by the conveying roller driving motor 940 is transmitted to the pulleys 941*b*, 941*c*, and 941*d* through the belt 942 from the pulley 941*a*. Consequently, the conveying rollers 943, 944, and 945 are rotated.

The second conveying mechanism 95 is constituted by a conveying roller driving motor 950 and conveying rollers 951 and 952. The conveying rollers 951 and 952 are rotated by the conveying roller driving motor 950.

A nip roller 963 is disposed in close proximity to the conveying roller 943 in the first conveying path 91. The nip roller 963 is supported so as to be swingable by a swinging member 962. A gear 961*a* is attached to a nip roller driving motor 960. The gear 961*a* is meshed with a gear 961*b* attached to the swinging member 962. When the nip roller driving motor 960 is rotated, the swinging member 962 swings through the gears 961*a* and 961*b*, and the nip roller 963 is brought into contact with the conveying roller 943. Consequently, the plate 100 is held by the conveying roller 943 and the nip roller 963.

A plate front end detecting sensor 970 for detecting the front end of the plate 100 is disposed at a front end of the first conveying path 91, and a plate rear end detecting sensor 971 for detecting a rear end of the plate 100 is disposed at the center of the first conveying path 91.

The operations of the conveying unit 9 and the punching device 10 will be described while referring to FIGS. 6 to 8.

As shown in FIG. 6, the conveying unit 9 is first moved toward an upper position by the conveying path switching motor 930. The plate 100 is set on the first conveying path 91 in the conveying unit 9, and the plate information such as the size of the plate 100 is entered from the operation panel 700 shown in FIG. 1, to issue a work instruction.

When the template 300 shown in FIG. 3 has the plurality of punching blocks 301 and 302 carried thereon, information relating to the recording drum positioning holes and the printing machine positioning holes can be also entered as the plate information from the operation panel 700.

The conveying roller driving motor 940 in the first conveying mechanism 94 is rotated, to convey the plate 100 to the punching device 10 as well as to move the moving bearings 202 to the vicinities of both ends of the punching base 200 by the moving motors 201 shown in FIG. 3 on the basis of the information relating to the size of the plate 100. When the plate front end detecting sensor 207 in the punching device 10 is turned on, the moving bearings 202 are moved toward the center of the punching base 200 by the moving motors 201 depending on the size of the plate 100 with the conveying roller driving motor 940 remaining rotated. Consequently, the plate 100 is positioned at the center of the punching base 200.

The reverse surface of the plate 100 is adsorbed under vacuum through the vacuum adsorption grooves 205, to fix the plate 100 to the punching base 200. Thereafter, the conveying roller driving motor 940 and the moving motors 201 are stopped.

In this case, the recording drum positioning holes 101 are formed at the front end of the plate 100 by the recording drum punching blocks 301 in the punching device 10 and at the same time, the printing machine positioning holes 102 are respectively formed in predetermined positions of the plate 100 by the printing machine punching blocks 302.

When the templates 300 have the plurality of punching blocks 301 and 302 carried thereon, the plate 100 is simultaneously punched using the punching blocks 301 and 302 selected from the plurality of punching blocks 301 and 302 on the basis of the plate information.

The nip roller 963 is then lowered by the nip roller driving motor 960 and is brought into contact with the conveying roller 943, to hold the plate 100. The adsorption under vacuum by the vacuum adsorption grooves 205 in the punching base 200 is released. The conveying roller driving motor 940 is then rotated in the reverse direction, to return the plate 100 to the first conveying path 91 in the conveying unit 9 until the plate front end detecting sensor 970 is turned off.

Figure 7:
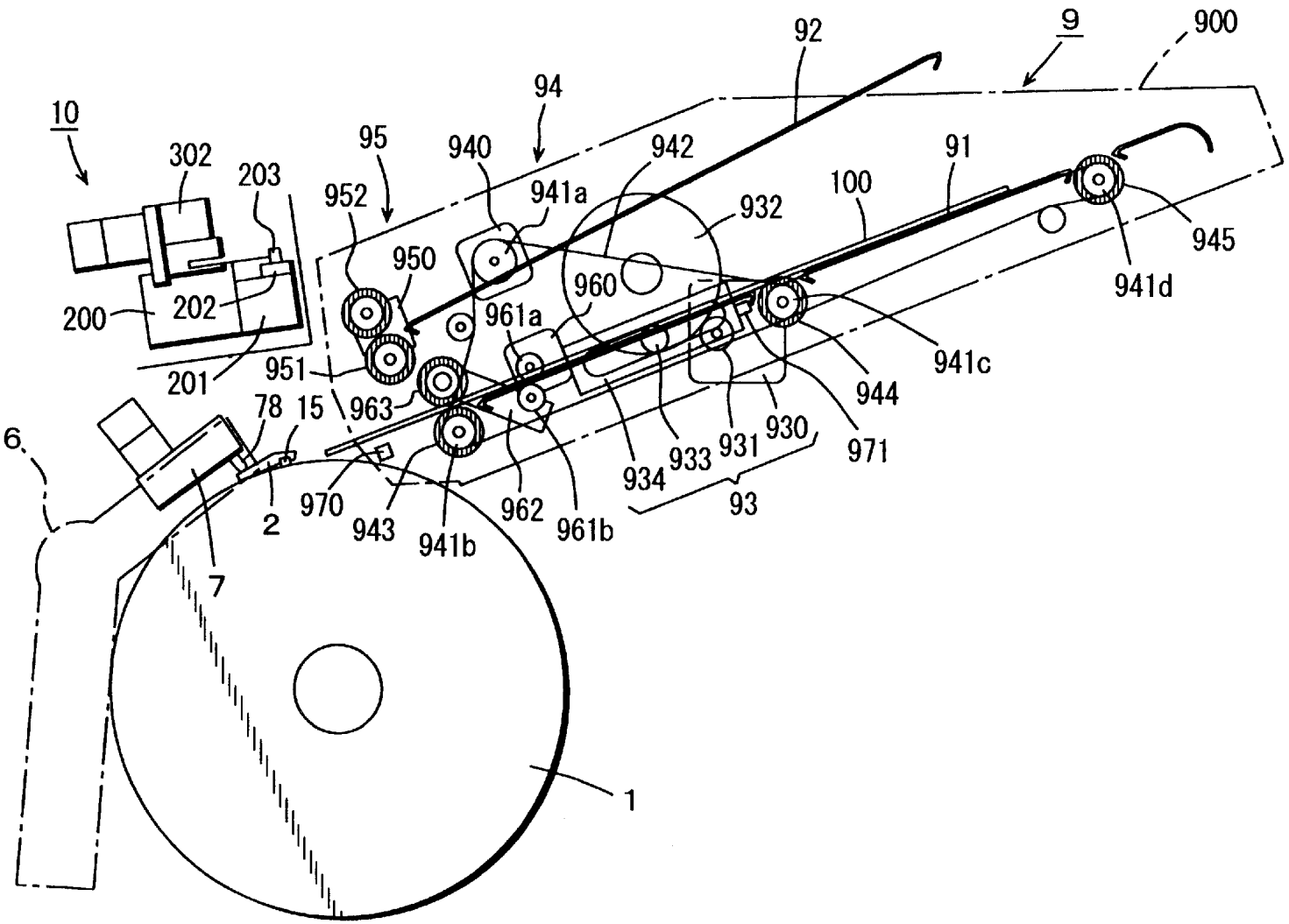
FIG. 7 is a side view showing the operation of the conveying unit shown in FIG. 6.

As shown in FIG. 7, the conveying unit 9 is swung toward a lower position by the conveying path switching motor 930. The nip roller 963 is spaced apart from the conveying roller 943 by the nip roller driving motor 960.

The clamp arms 6 are swung, to bring the first driving devices 7 near the outer peripheral surface of the recording drum 1. The release pin 78 in each of the first driving devices 7 presses a rear end of the front end clamp 2. Consequently, a clearance is formed between front ends of the front end clamps 2 and the outer peripheral surface of the recording drum 1.

In this state, the conveying roller driving motor 940 is rotated, to convey the plate 100 toward the recording drum 1, the front end of the plate 100 is inserted into the clearance between the front end of the front end clamps 2 and the outer peripheral surface of the recording drum 1, and the recording drum positioning holes 101 of the plate 100 are respectively fitted on the positioning pins 15 on the recording drum 1.

After the conveying roller driving motor 940 is stopped, the clamp arm 6 is returned in the reverse direction, to space the release pin 78 in each of the first driving devices 7 apart from the front end clamp 2. Consequently, the front end of the plate 100 is fixed to the outer peripheral surface of the recording drum 1 by the front end clamps 2.

Thereafter, the conveying roller driving motor 940 is rotated, and the recording drum 1 is rotated, to wind the plate 100 around the outer peripheral surface of the recording drum 1, and the rear end of the plate 100 is then fixed to the outer peripheral surface of the recording drum 1 by the rear end clamps 3, as shown in FIG. 3.

The plate 100 is thus fixed to the outer peripheral surface of the recording drum 1, so that an image is drawn on the plate 100 by the recording head 8 shown in FIG. 1.

When the drawing of the image on the plate 100 by the recording head 8 is terminated, the rear end clamps 3 are released by the first driving devices 7 in the clamp driving device 5, and the recording drum 1 is then rotated in the reverse direction.

Figure 8:
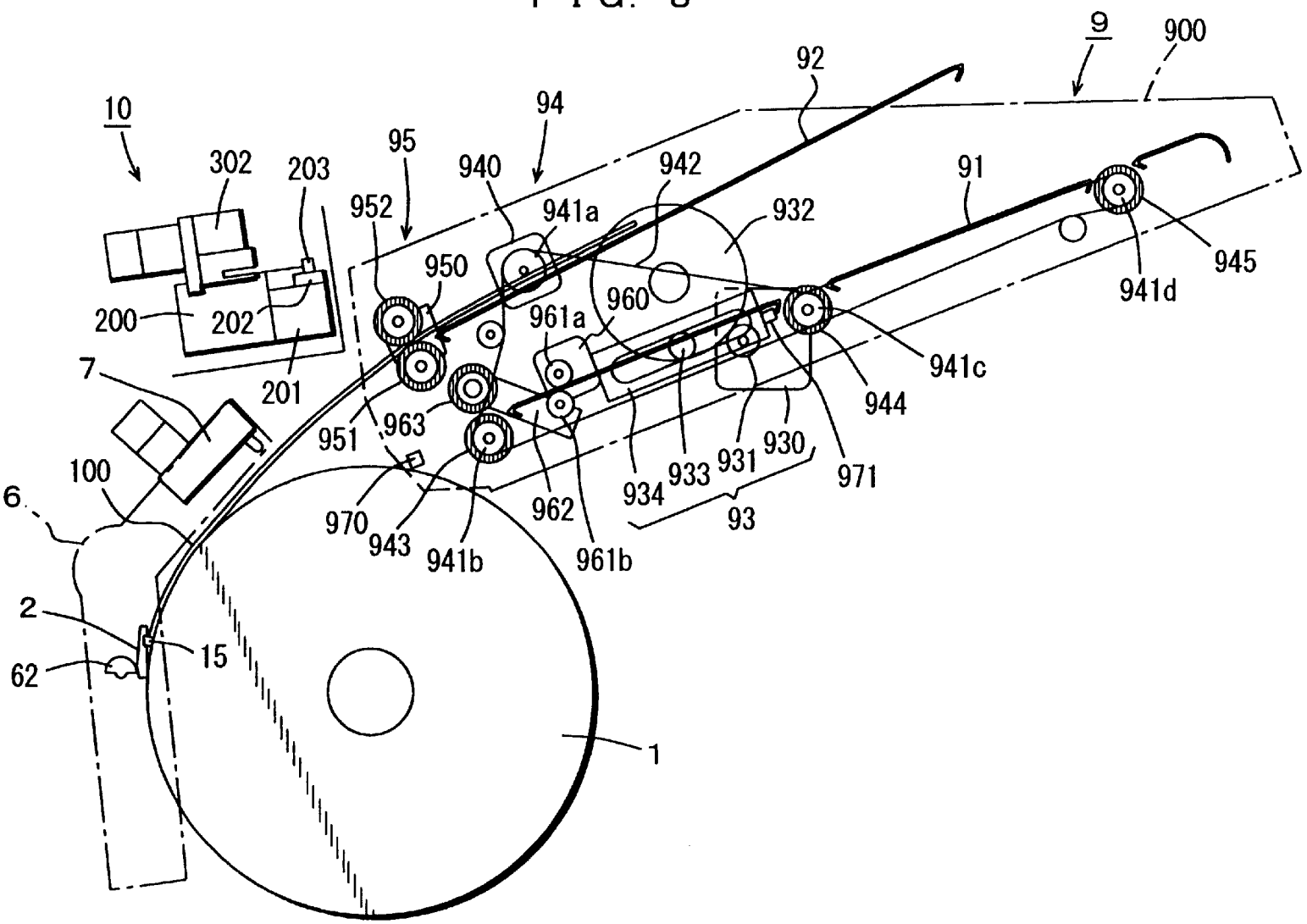
FIG. 8 is a side view showing the operation of the conveying unit shown in FIG. 6.
Figure 9:
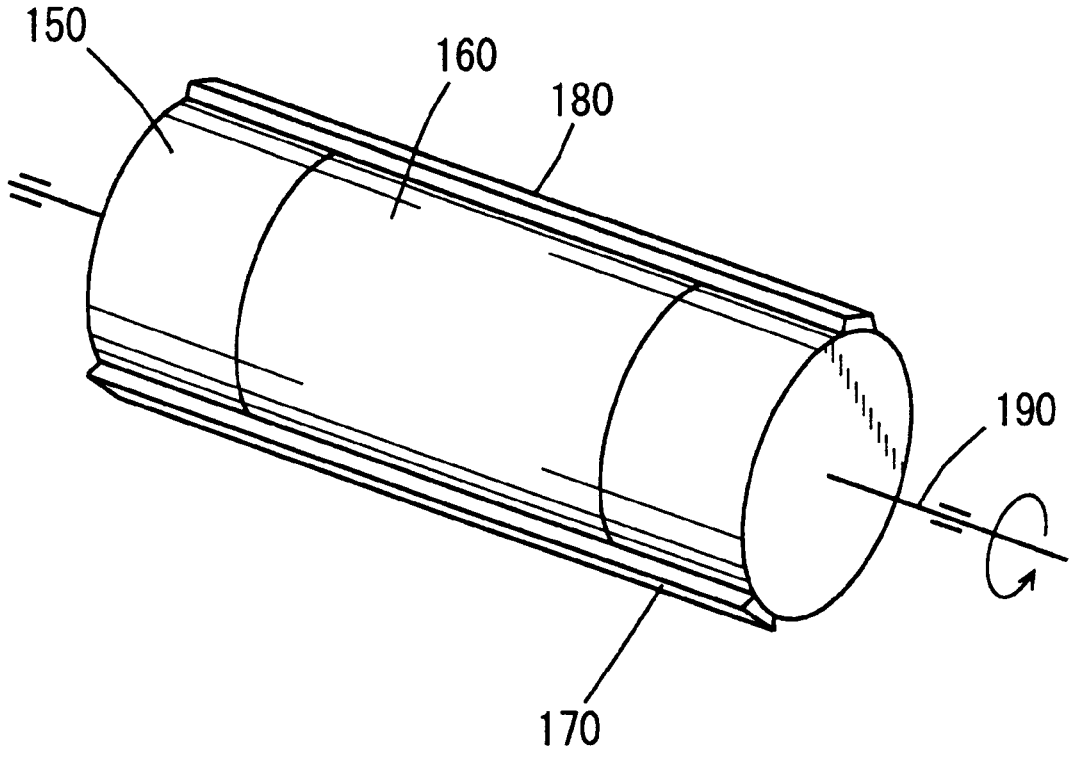
F I G. 9 PRIOR ART
FIG. 9 is a perspective view of a recording drum in a conventional drawing apparatus.

As shown in FIG. 8, the front end of the plate 100 is inserted between the conveying rollers 951 and 952 in the second conveying mechanism 95 in the conveying unit 9, and the conveying rollers 951 and 952 are rotated by the conveying roller driving motor 950, to pull the plate 100 into the second conveying path 92 in the conveying unit 9. Thereafter, the front end clamps 2 on the recording drum 1 are released by a second driving device 62 in the clamp driving device 5, to carry the plate 100 outward through the second conveying path 92 in the conveying unit 9.

In the drawing apparatus according to the present embodiment, the recording drum positioning holes 101 and the printing machine positioning holes 102 are simultaneously formed in the plate 100 by the punching device 10 before the image is drawn by the recording head 8. Accordingly, the image is drawn by the recording head 8 in a state where the recording drum positioning holes 101 are respectively positioned on the positioning pins 15 of the recording drum 1. Consequently, the relationship between the image formed on the plate 100 and the printing machine positioning holes 102 can be kept constant irrespective of the variation in the size of the plate 100. In doing the printing by the printing machine using the plate 100, the position of printing is not shifted. As a result, no work for correcting the shift in the position of printing is required, thereby improving the efficiency of the printing work.

The templates 300 mounted on the punching base 200 in the punching device 10 are replaced, thereby making it possible to respectively form the recording drum positioning holes 101 and the printing machine positioning holes 102 in suitable positions of the plate 100 in conformity with the size of the plate 100 and the specification of the printing machine.

Alternatively, the templates 300 having the plurality of punching blocks 301 and 302 corresponding to the plurality of types of plates 100 or the plurality of types of printing machines carried thereon are used, to select the punching blocks 301 and 302 depending on the type of plate 100 and the type of printing machine. Accordingly, it is possible to respectively form the recording drum positioning holes 101 and the printing machine positioning holes 102 in suitable positions of the plate 100 in conformity with the size of the plate 100 and the specification of the printing machine.

Consequently, work costs in fabricating the plates 100 corresponding to various types of printing machines are reduced.

When the positioning pins 15 are respectively provided in positions, corresponding to the positioning pins of the printing machine, in the recording drum 1, the recording drum positioning holes 101 and the printing machine positioning holes 102 can be made common. In this case, the templates 300 having the printing machine punching blocks 302 carried thereon are mounted on the punching base 200 in the punching device 10.

Although in the above-mentioned embodiment, the recording drum positioning hole 101 is formed in a U shape, the shape of the recording drum positioning hole 101 is not limited to the U shape. For example, the recording drum positioning hole 101 may have another shape, provided that it is fitted on the positioning pin 15 of the recording drum 1.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of drawing an image on a plate which is used for a printing machine having a positioning portion and mounted on an outer peripheral surface of a cylindrical drum, wherein said drum has a rotary shaft and a positioning portion provided on said outer peripheral surface, comprising the steps of:

forming in the plate a first fitting portion to be fitted to said positioning portion of said drum and a second fitting portion to be fitted to a positioning portion of the printing machine;

mounting the plate having said first fitting portion and said second fitting portion formed therein on the outer peripheral surface of said drum; and drawing an image on the plate on said outer peripheral surface of said drum while rotating said drum around said rotary shaft.

2. The drawing method according to claim 1, wherein said positioning portion of said drum is a positioning pin, and said positioning portion of said printing machine is a positioning pin, and said step of forming comprises the step of forming in the plate a first positioning hole to be fitted on the positioning pin of said drum and a second positioning hole to be fitted on the positioning pin of the printing machine, respectively, as said first fitting portion and said second fitting portion.

3. A drawing apparatus for drawing an image on a plate used for a printing machine having a positioning portion, comprising:

a cylindrical drum having a rotary shaft, an outer peripheral surface on which the plate is mounted, and a positioning portion provided on said outer peripheral surface;

a driving device for rotating said drum around said rotary shaft;

a drawing unit for drawing an image on the plate mounted on the outer peripheral surface of said drum; and a fitting portion forming device for forming in the plate a first fitting portion to be fitted to said positioning portion of said drum and a second fitting portion to be fitted in the positioning portion of the printing machine before the plate is mounted on said drum.

4. The drawing apparatus according to claim 1, wherein said positioning portion of said drum is a positioning pin, said positioning portion of the printing machine is a positioning pin, said first fitting portion is a first positioning hole to be fitted on the positioning pin of said drum, and said second fitting portion is a second positioning hole to be fitted in the positioning pin of the printing machine.

5. The drawing apparatus according to claim 4, wherein said fitting portion forming device comprises a plurality of punching units for forming said first and second positioning holes in the plate.

6. The drawing apparatus according to claim 5, wherein said fitting portion forming device further comprises a supporting member disposed in a predetermined position, and a mounting member provided in said supporting member so as to be attachable or detachable and having said plurality of punching units carried thereon.

7. The drawing apparatus according to claim 6, wherein said supporting member has a reference surface, and said mounting member has one end surface which is abutted against said reference surface of said supporting member.

8. The drawing apparatus according to claim 6, wherein said fitting portion forming device further comprises a positioning mechanism for positioning the plate in a predetermined position of said supporting member.

9. The drawing apparatus according to claim 8, wherein said positioning mechanism comprises a pair of abutting members provided so as to be abuttable against both side surfaces of said plate upon being moved from on the both sides of the plate toward the center thereof, and an abutting member driving device for moving said pair of abutting members from on the both sides of the plate toward the center thereof.

10. The drawing apparatus according to claim 9, wherein said positioning mechanism further comprises a sensor for detecting an end of the plate, said abutting member driving device moving said pair of abutting members from on the both sides of the plate toward the center thereof after the end of the plate is detected by said sensor.

11. The drawing apparatus according to claim 6, wherein said fitting portion forming device further comprises adsorbing and holding means for adsorbing and holding the plate on said supporting member.

12. The drawing apparatus according to claim 5, further comprising selection means for selecting said plurality of punching units.

13. The drawing apparatus according to claim 12, wherein said selection means comprises input means for inputting information for selecting any of said plurality of punching units.

14. The drawing apparatus according to claim 3, further comprising a conveying unit for conveying the plate to said fitting portion forming device, and then conveying said plate to said drum.

15. The drawing apparatus according to claim 14, wherein said conveying unit further comprises a first conveying path for conveying the plate to said fitting portion forming device and said drum, and a swinging mechanism for swinging said first conveying path between said fitting portion forming device and said drum.

16. The drawing apparatus according to claim 15, wherein said conveying unit further comprises a second conveying path for conveying the plate removed from said drum.

17. The drawing apparatus according to claim 15, wherein said conveying unit further comprises a first conveying mechanism for moving the plate along said first conveying path.

18. The drawing apparatus according to claim 17, wherein said conveying unit further comprises a second conveying mechanism for moving the plate along said second conveying path.

* * * * *